US007140469B2

(12) United States Patent
Deplazes et al.

(10) Patent No.: US 7,140,469 B2
(45) Date of Patent: Nov. 28, 2006

(54) THREE-DIMENSIONAL MONITORING IN THE AREA OF AN ELEVATOR BY MEANS OF A THREE-DIMENSIONAL SENSOR

(75) Inventors: Romeo Deplazes, Oberrüti (CH); Elena Cortona, Thalwil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/230,688

(22) Filed: Sep. 20, 2005

(65) Prior Publication Data

US 2006/0037818 A1 Feb. 23, 2006

(51) Int. Cl.
*B66B 13/14* (2006.01)

(52) U.S. Cl. ..... 187/316; 187/391

(58) Field of Classification Search ..... 187/247, 187/248, 313, 316, 317, 391; 49/26, 28; 318/280–286, 466–470, 481; 382/103–107
See application file for complete search history.

(56) References Cited

U.S. PATENT DOCUMENTS

| | | | | |
|---|---|---|---|---|
| 3,852,592 | A * | 12/1974 | Scoville et al. | 250/221 |
| 4,029,176 | A * | 6/1977 | Mills | 187/317 |
| 5,001,557 | A | 3/1991 | Begle | |
| 5,284,225 | A * | 2/1994 | Platt | 187/316 |
| 5,345,049 | A | 9/1994 | Bahjat et al. | |
| 5,387,768 | A | 2/1995 | Izard et al. | |
| 6,050,369 | A | 4/2000 | Leone et al. | |
| 6,051,829 | A * | 4/2000 | Full | 250/221 |
| 6,167,991 | B1 * | 1/2001 | Full et al. | 187/317 |
| 6,339,375 | B1 * | 1/2002 | Hirata et al. | 340/541 |
| 6,973,998 | B1 * | 12/2005 | Deplazes et al. | 187/316 |

FOREIGN PATENT DOCUMENTS

| | | |
|---|---|---|
| EP | 0 448 803 | 10/1991 |
| EP | 1 074 958 | 2/2001 |
| WO | WO01/42120 | 6/2001 |

OTHER PUBLICATIONS

Jeremias, Ralf et al., "*A CMOS Photosensor Array for 3D Imaging Using Pulsed Laser*", Tech. Digest, IEEE Int'l Solid State Circuits Conference (ISSCC 2001), San Francisco, CA, pp. 252-3, 452-3.

* cited by examiner

*Primary Examiner*—Jonathan Salata
(74) *Attorney, Agent, or Firm*—Butzel Long

(57) ABSTRACT

A device for monitoring an elevator area utilizes a three-dimensional semiconductor sensor for detecting three-dimensional image information. The sensor includes a light source that is mounted so that the elevator area to be monitored is disposed in the illuminated area of the light source, a sensor group that is mounted in such a manner that it receives reflected light, and a processing chip for converting the electrical signals into image information. In addition, the device includes a processing device that is connected with the semiconductor sensor in order to make available three-dimensional image information. The processing device processes the image information in order to obtain state information representing the state of the elevator area to be monitored.

17 Claims, 6 Drawing Sheets

THREE-DIMENSIONAL MONITORING IN THE AREA OF AN ELEVATOR BY MEANS OF A THREE-DIMENSIONAL SENSOR

BACKGROUND OF THE INVENTION

The present invention relates to a device for monitoring an elevator area, a method for elevator area monitoring, and a software module for elevator area monitoring.

Elevator systems comprise at least one elevator car which is movable in an elevator shaft or freely along a transport device. The elevator car is usually moved from floor to floor in order to allow persons to board and alight there or in order to be loaded or unloaded there.

The interior space of the elevator car, but also the access region disposed in front of the elevator shaft, is particularly critical since, for example, in the case of faulty functioning of the elevator a risk to persons can arise. As an example, the opening of a shaft door may be mentioned, although no elevator car is located behind the shaft door that is opening. In addition, for example, it is also possible to be caught in the door region.

It is also conceivable that inappropriate behavior of a person, faulty handling of the elevator or inexpert loading or unloading of the elevator leads to problems.

There is therefore noted a tendency to monitor these critical areas in order to be able to recognize problems in good time and, in particular, to avoid risk to persons.

Mechanical, magnetic, inductive or similar switches are frequently used for monitoring the doors of an elevator. In addition, optical systems, such as, for example, light barriers or light gratings are used. With approaches of that kind certain information—for example, about the status of the doors—can be supplied to the elevator control. However, the information content is relatively limited, since, for example, a switch is only in a position of indicating two states (digital information whether a door is open or closed). Monitoring solutions of that kind are predominately limited to the immediate vicinity of the car doors and/or shaft doors.

In order to be able to construct a more complex monitoring system there is needed, for example, a combination of several switches and light barriers.

Optical systems in particular have certain advantages, since by contrast to mechanical solutions they operate contactlessly and are not subject to mechanical wear. Unfortunately, even in the case of more complex optical systems such as are used in elevators the meaningfulness is limited to a few states and the detection range is rather restricted. It is possible to detect, for example, whether anybody is in the door area, and movements are able to be recognized. Larger three-dimensional areas cannot, however, be so reliably monitored. In addition, the reaction time of light barriers or light gratings is approximately 65 milliseconds, which in certain circumstances can be too long.

Certain optical photosensors even enable detection of three-dimensional images, wherein mechanically moved parts—for example, in the form of mirrors—are used. These sensors are complicated and costly.

A system for monitoring elevator doors is shown in PCT Patent Application WO 01/42120, which operates with a pre-programmed processor, a digital camera, an analog camera or a video camera. The camera supplies a sequence of two-dimensional images, through the comparison of which information about the state of elevator doors is made available. This system operates with external light which is intercepted and received by the camera. This leads to problems in situations where the intensity of the outside light strongly varies—for example, in the case of incidence of sunlight—and thus the image brightness strongly increases.

Conversely, the use of such a camera for that purpose can also be problematic when the outside light which is present is insufficient. In the case of area monitoring it is essential that the monitoring functions securely and reliably in all circumstances. A dependence on outside light is problematic from this viewpoint. According to the above-identified PCT patent application there is used a classical pattern recognition approach (pattern matching) in order to be able to evaluate the sequence of two-dimensional images. A system operating according to the PCT patent application with two-dimensional images cannot make any statement about distances. A specific statement about movements and movement directions is possible with such a two-dimensionally operating system only by computer-intensive reprocessing of the supplied images.

A further monitoring system is described in U.S. Pat. No. 5,387,768. The system described there uses a camera, images of which are provided in a complicated mode and manner in order to be able to make a statement about whether and how many persons are present in the region of the elevator. The camera makes recording sequences with different zoom settings so as to be able to produce a statement therefrom about possible movements.

In U.S. Pat. No. 5,345,049 an elevator is described in which it is detected by means of an infrared sensor or infrared sensors whether one or more persons wait in the access area of the elevator. Determination of the number of persons does not take place here.

Three-dimensional semiconductor sensors are known which enable three-dimensional detection of image information. Sensors of that kind are known from, for example, the article "Fast Range Imaging by CMOS Sensor Array Through Multiple Double Short Time Integration (MDSI)", P. Mengel et al., Siemens AG, Corporate Technology Department, Munich, Germany. Such a three-dimensional semiconductor sensor can be used for three-dimensional monitoring.

A further example is described in the article "A CMOS Photosensor Array for 3D Imaging Using Pulsed Laser", R. Jeremias et al., 2001 IEEE International Solid-State Circuits Conference, page 252.

Elevator systems with access control exist. Such systems operate, for example, by means of badges and badge reading apparatus. Thus, it is possible to check whether a person is authorized to use the elevator. Only a person recognized by badge can call an elevator and select a destination floor. To that extent systems of that kind function reliably. However, who and how many persons enter the elevator car are hardly capable of checking by current approaches. Access can be additionally controlled by appropriate constructional measures, for example a turnstile, an access gate or other architectonic measures. However, these approaches are complicated and often not suitable for aesthetic reasons.

In the case of present-day identification systems for elevator utilization it thus cannot be ensured that in fact only authorized persons enter an elevator car or leave at a floor for which they have access authorization.

SUMMARY OF THE INVENTION

The present invention concerns an apparatus for providing improved elevators. It is an object of the present invention to enable an accurate and reliable area monitoring at elevators.

It is a further object of the present invention to realize reliable and fast-acting problem recognition for elevators.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1A:
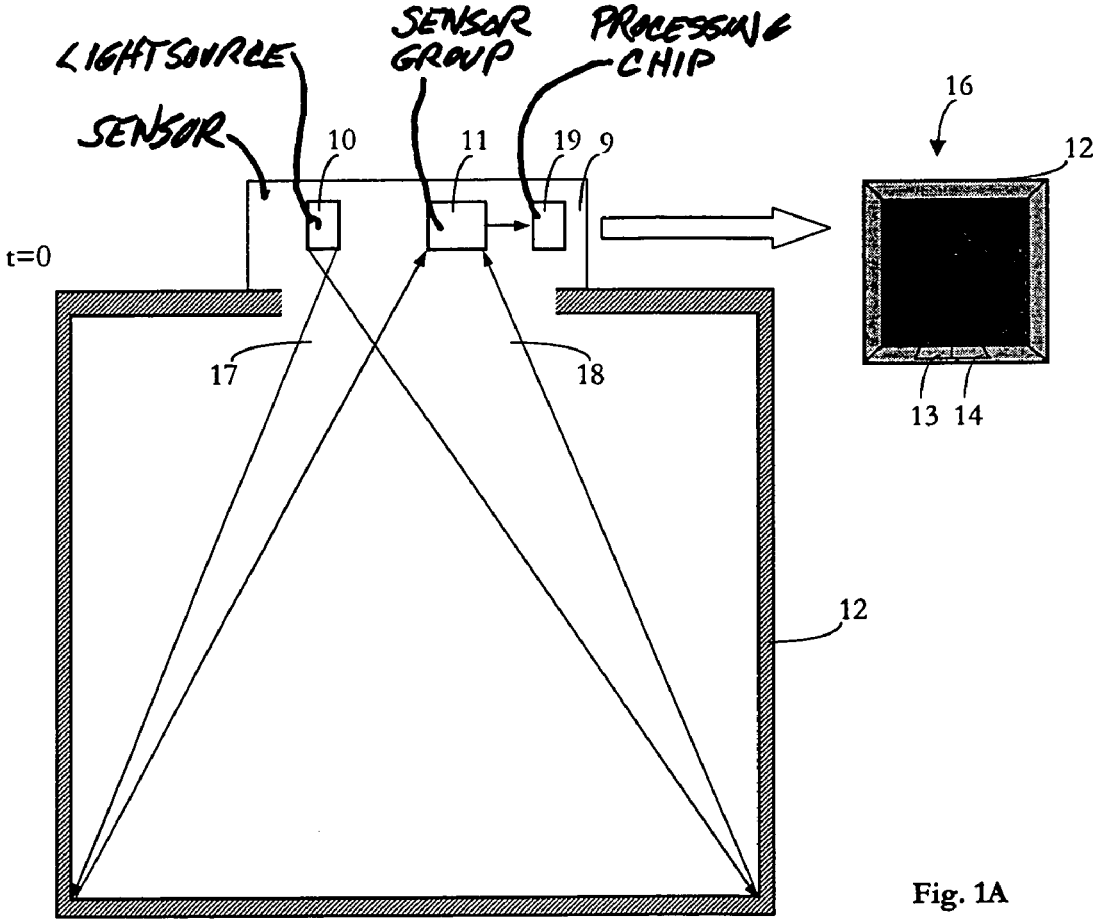
FIGS. 1A and 1B are schematic side elevation sectional views of the car of an elevator with a sensor according to the present invention.

According to the present invention for the first time a novel optical three-dimensional sensor is used in the field of elevators. This sensor is preferably a three-dimensional sensor operating in the infrared range. A three-dimensional sensor comprising an optical transmitter for pulse-like transmission of light and a CMOS sensor group for reception of light is particularly suitable. Ideally, the optical transmitter is a light-emitting diode or laser diode which, for example, transmits light in the infrared range, wherein the light is emitted in short pulses, quasi in a manner of flashes. The pulses can be several tens of nanoseconds long. The diode is for this purpose preferably provided with an (electrical) shutter which interrupts the emitted light. However, the diode can also be pulsed directly. The sensor group serves as an image sensor that converts light into electrical signals. The sensor group preferably consists of a number of light-sensitive elements. The sensor group is connected with a processing chip (for example, a CMOS sensor chip) which determines the transit time of the emitted light in that a special integration method (multiple double short-time integration, termed MDSI) is carried out. In that case the processing chip simultaneously measures, in a few milliseconds, the spacing from quite a number of target points in space. In that case a three-dimensional resolution of five millimeters can typically be achieved.

A further three-dimensional sensor, which apart from other three-dimensional sensors is also suitable for use in conjunction with the present invention, is based on a distance measuring principle in which the transit time of emitted light is detected by way of the phase of the light. In that case the phase position on transmission of the light and on reception is compared and the time covered or the spacing from the reflecting object is ascertained therefrom. For this purpose preferably a modulated light signal is emitted instead of short light pulses.

In order to suppress the influences of extraneous light it is possible to undertake a double scanning in which scanning is once with and once without light. Two electrical signals (once with active illumination, once without), which can be converted by subtraction into a definitive signal substantially independent of extraneous light, are then obtained. Such a sensor can be reliably used even in the case of solar irradiance and in the case of changing light influences.

The three-dimensional sensor is preferably realized from semiconductor components, which leads to a high degree of reliability and robustness. In addition, such a three-dimensional sensor is particularly small and can be rendered capable of manufacture in advantageous manner by mass production.

Through the detection of three dimensions it is possible to realize a device which directly detects the positions of persons or other objects, the distances between these and even the movements and directions of movement thereof. For this purpose a processing device can be used (for example, a personal computer or a central processor unit with peripheral components) which executes three-dimensional mathematical operations. This form of three-dimensional mathematical operations is significantly different from the previously employed special pattern recognition approaches which, for example, operate with different grey stages.

Figure 1B:
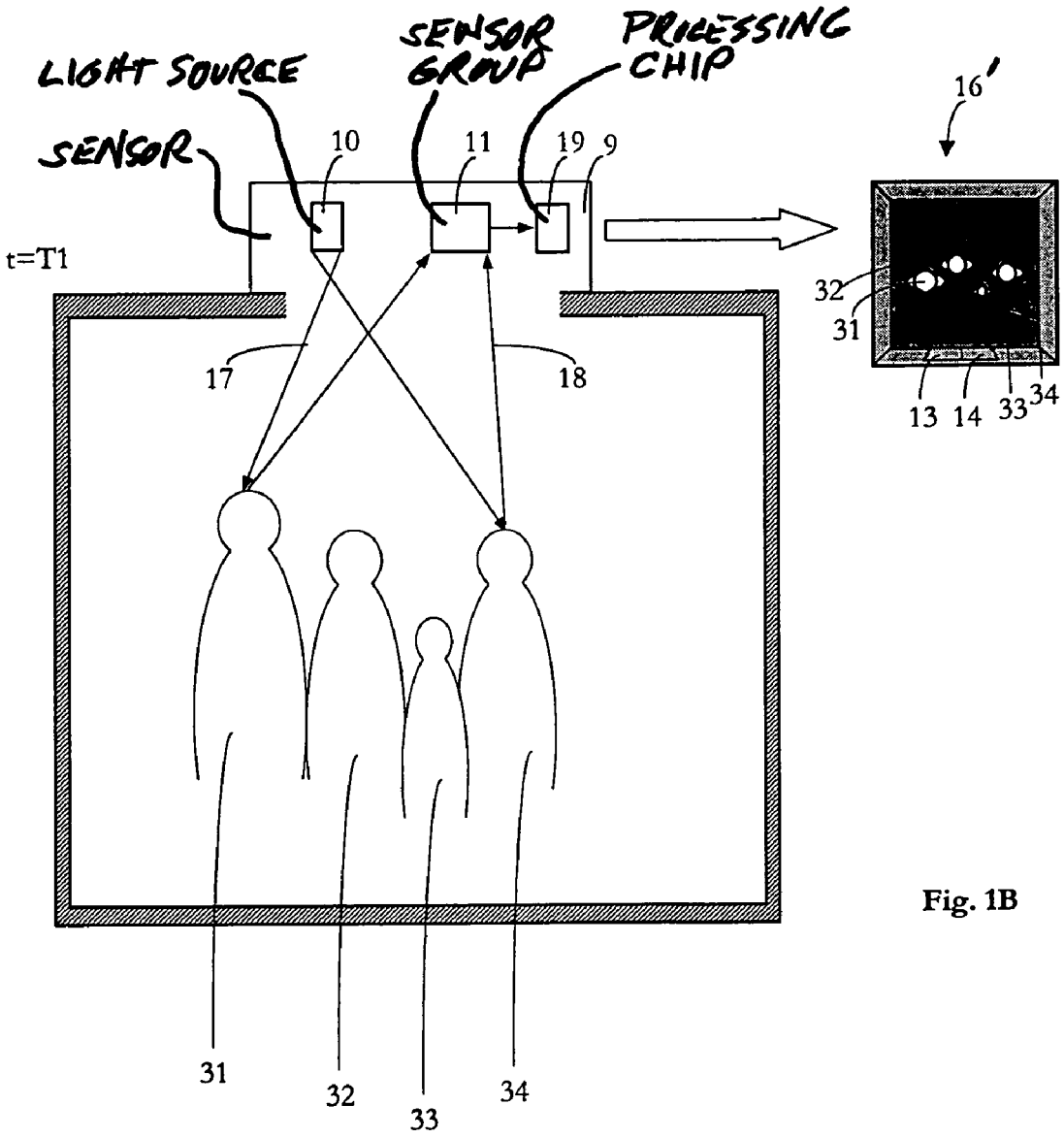

A first embodiment of a device according to the present invention is shown in FIGS. 1A and 1B in a schematic section. This embodiment is a device for area monitoring, wherein in the present example the interior area of an elevator car is monitored. The device comprises a three-dimensional semiconductor sensor 9 that is mounted in the region above an elevator car 12 to be monitored in such a manner that the interior space of the car 12 is disposed at least partly in a detection range 17, 18 of the sensor 9. For better illustration of the sensor this is shown substantially larger than it is in reality. The sensor 9 comprises a laser diode 10 serving as a light source and emitting a self-luminous component. Depending on the respective optical beam shape an illuminated area in the form of, for example, the light cone 17 results. A sensor group 11 is provided which serves as an image sensor and receives, by way of the light cone 18, light information and converts this into electrical signals. The light information is prepared by a processing chip 19 and transformed into image information 16 (for example, in the form of a three-dimensional distance image). An example of such a three-dimensional distance image 16 is illustrated in FIG. 1A in substantially simplified form. It can be inferred from the distance image 16 that the car 12 is empty. Car doors 13 and 14 are closed. It is schematically indicated in FIG. 1A that the distance image 16 is a three-dimensional image of the interior of the elevator car 12.

If the detecting process is repeated at a later instant "T1", then the distance image 16' shown in FIG. 1B results. The distance image 16' shows that in total four persons 31, 32, 33 and 34 are in the car 12. The distance image 16' is a three-dimensional image of the elevator car 12 and the persons 31 to 34.

The laser pulses transmitted in the direction of the car 12 are preferably synchronized in relation to the start of an integration window. The laser pulse received by the sensor group 11 after reflection within the car 12 triggers, after a transit time "T0", a linearly rising sensor signal "X(t)" which, for example, can be measured at the integration instants "T2" and "T3". Depending on the spacing of the light source 10 from the different three-dimensional points and from there to the sensor group 11 only a fraction of the original intensity of the light pulse is detected while the integration time window "T2" to "T3" is active. If, for example, two integration measurements are made at the different times "T2" and "T3" (wherein T0<T2<T3) the position and rise of the integrated intensity signal "X(t)" can be ascertained. The transit time "T0" can thus be precisely determined and therewith also the spacing from persons or objects. An evaluation of that kind of the light information by the processing chip 19 makes it possible to obtain information which is not instantaneously obtainable in other mode and manner.

A part of this processing takes place in the processing chip 19 and not only in a separate processing unit. This means that a part of the processing is carried out by appropriate hardware, which is reliable and rapid.

Two different processing approaches can be used. In the case of a first approach according to the present invention the sensor group comprises "n" light-sensitive elements (n>0). Each of these light-sensitive elements supplies an intensity signal "$x_n(t)$", the strength of which is dependent on the intensity of the light received by the respective light-sensitive element. These intensity signals "$x_n(t)$" can be combined—for example, by a form of superimposition—to form an intensity signal "X(t)". After this combining, the above-described evaluation can then be carried out, in which the instant "T0" is ascertained from the position and rise of the intensity signal "X(t)". In the case of this embodiment the area resolution of the arrangement is reduced, since several light-sensitive elements are evaluated in common. It is nevertheless possible to ascertain the transit time and thus the spacing from reflecting objects disposed in the monitored area. A three-dimensionally operating sensor device, the depth resolution of which is better than the area resolution, is thus obtained.

In the case of a second approach according to the present invention the sensor group again comprises "n" light-sensitive elements (n>0). Each of these light-sensitive elements supplies an intensity signal "$x_n(t)$", the strength of which is dependent on intensity of the light received by the respective light-sensitive element. These intensity signals "$x_n(t)$" can then run through the above-described evaluation, wherein each of the intensity signals "$x_n(t)$" is individually processed, preferably simultaneously. The respective instant "$T_n$0" can be ascertained from the position of and rise in each of the intensity signals "$x_n(t)$". Preferably, the processing chip 19 comprises several parallel channels (preferably "n" channels) for processing of the "n" intensity signals "$x_n(t)$". In the case of this embodiment there results an area resolution, since several points in space (for example, several points of an object disposed in the monitored space) can be detected independently of one another. It is possible to ascertained the transit time "$T_n$0" and thus the spacing for each of these points in space. A three-dimensionally operating sensor device with depth resolution and area resolution is thus obtained.

Figure 2:
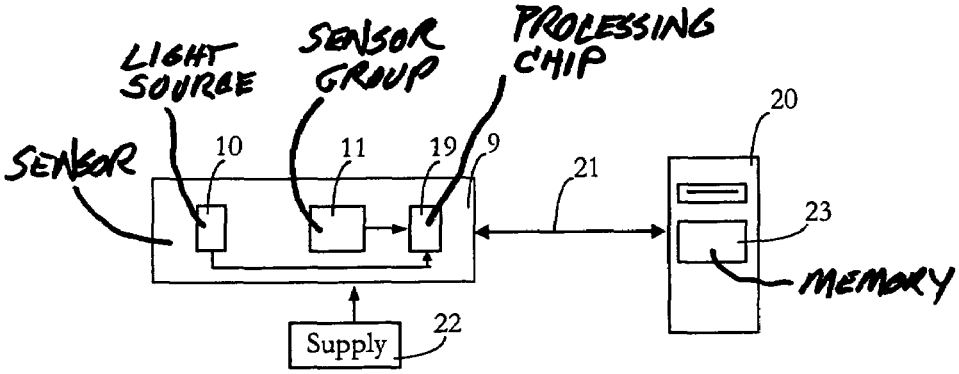
FIG. 2 is a schematic block diagram the sensor shown in FIGS. 1A and 1B with a processing device.

As shown in FIG. 2, the device according to the present invention additionally comprises a processing device 20, which, for example, is disposed in connection with the sensor 9 by way of a communications connection 21. The communications connection 21 serves for transmission of electrical signals, which represent image information (also termed state information), from the sensor 9 to the processing device 20. In addition, the device comprises a supply means 22 (for example, a voltage source) for supply of the sensor 9. The processing device 20 is designed by the installation of a software module in such a manner that the image information can be evaluated so as to enable the area monitoring.

In one possible embodiment the image information is further evaluated by the processing device 20 in order to obtain information about the state of the monitored area. For this purpose, for example, the state information obtained from the image information can be compared with target information. For this purpose the processing device 20 can comprise means for provision of the target information. The means can be, for example, an internal hard disc memory 23. It is possible, for example, that the distance image 16 shown in FIG. 1A is stored as target information in the hard disc memory. The processing device 20 can ascertain by a comparison algorithm whether the just-obtained state information corresponds with the target information. If this is the case, then it can be assumed that the car interior space is empty.

Other target information can also be predetermined, by which the processing device 20 undertakes respective comparisons. A specific reaction can, for example, be assigned to each piece of target information.

In the case of another embodiment the image information is processed in preliminary manner by the processing chip 19 in terms of hardware and then evaluated by the processing device 20 without having to compare the state information with the target information. In this connection there is comparison with one another of image information which was detected by the sensor 9 at at least two instances following one another in quick succession in time. Such a comparison can be carried out by, for example, suitable computerized superimposition of the image information. If the image information is subtracted at the instant t=0 from the image information at the instant t=a1, then the processing device 20 can recognize changes in the three-dimensional space.

Figure 3:
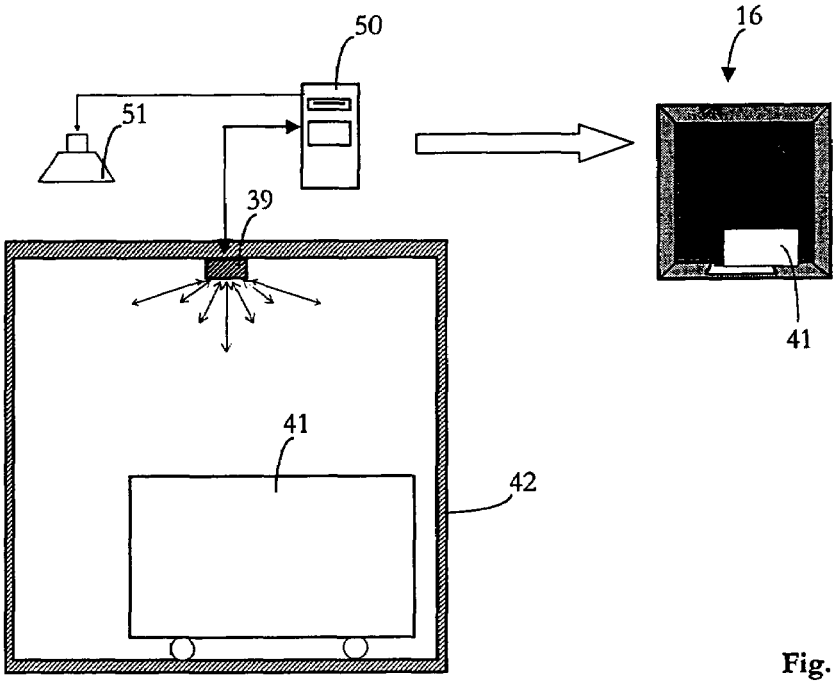
FIG. 3 is a schematic side elevation sectional view of a car of an elevator with an alternate embodiment sensor according to the present invention.

A further embodiment of the present invention is shown in FIG. 3. A sensor 39 is now illustrated in realistic size in FIG. 3. It is arranged in an upper region of an elevator car 42 and covers, from above, the interior space of the car 42 to be monitored, as indicated by the small arrows in the vicinity of the sensor 39. An object 41 is located in the elevator car 42 relatively close to the open car doors. The device is in a position of recognizing whether the car doors are open, since in the case of open doors a strong brightness different results. The sensor 39 is connected with a processing device 50 which comprises a suitable software module. The entire device is designed so that in a first step it can be detected whether a person and/or an object is located in the interior of the car 42. If this is the case, then in a next step a form of classification is carried out. This classification makes it possible for the device to trigger situation-adapted reactions. In the illustrated example the device is in a position of recognizing whether persons and/or objects are located in the elevator. By virtue of the clear rectangular geometry the device can recognize that the object 41 must be concerned. Next, the device can, for example, seek to recognize the position of the object 41 within the car 42 in order to be able to derive reactions therefrom. In the illustrated example the object 41 is disposed very close to the opened door. A possible reaction would need to make an acoustic warning by way of a loudspeaker 51 in order to require the person who has loaded the elevator to move the object 41 further into the interior space of the car 42. As long as this has not taken place, closing of the doors by the device is precluded.

Figure 4:
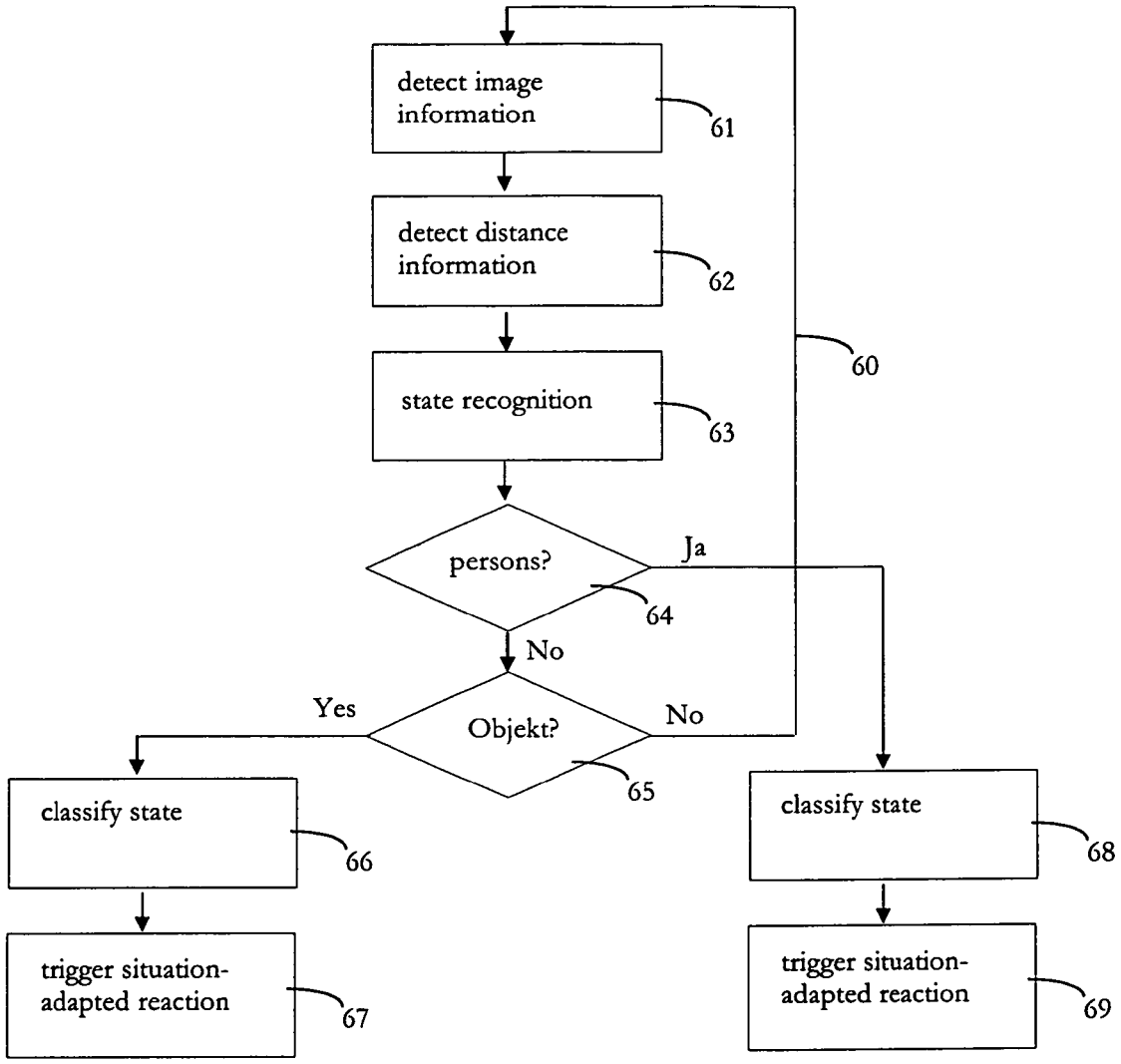
FIG. 4 is a schematic flow chart of a method of operation of the sensor according to the present invention.

A method according to the present invention for area monitoring comprises several method steps, as shown in an example in FIG. 4. There is detection by a sensor (for example the sensor 9 in FIG. 1A) of light (step 61 in FIG. 4) which is reflected at different spatial points in the area to be monitored. This light originates from a light source (for example the light source 10 in FIG. 1A). Distance information is ascertained (step 62 in FIG. 4) from the detected light. In that case the transit time of the light is taken into consideration. In order to enable this, a synchronization takes place between the light source and the sensor group. This step is preferably carried out in a special processing chip (for example, the processing chip 19 in FIG. 1A). Evaluation of the distance information then takes place (step 63) for recognition of a state in the monitored area. It is ascertained by the processing device in a processing step 64 whether persons are in the monitored area. If this is not the case (branch at "No"), then it is ascertained whether objects are located in the monitored area (step 65). If persons were recognized in the monitored area, then the method branches at "Yes". A classification can take place in a further step 68. Some examples of classification are listed in the following:

- ascertain number of persons,
- recognize position of the person or persons within the monitored area,
- detect movements or movement directions,
- check authorization,
- check whether several persons in the monitored area are as predetermined, etc.

Depending on the respective classification, one or more of the following reactions, which are by way of example, are triggered in a step 69:

- wait until further persons have boarded before the elevator car is set in motion;
- in the case of overloading, do not set the elevator car in motion and/or make an announcement;
- if one or more persons is or are too close to the door region, either wait until the situation has changed or make an announcement;
- if a person moves in the direction of the doors, appropriately adapt the door opening or closing process (for example, stop or slow down closing of the doors); and
- if an unauthorized elevator user appears to be in the car, either make an announcement or trigger an alarm call.

If the device has ascertained that an object is located in the car, then the method branches at "Yes" and a classification can take place in a further step 66. Some examples of classification are listed in the following:

- ascertain number of the objects;
- ascertain kind of objects;
- ascertain size of the objects;
- recognize position of the object or objects within the monitored area; and
- detect movements or directions of movement of objects.

Depending on the respective categorization one or more of the following reactions, which are by way of example, can be triggered in a step 67:

- in the case of overloading, do not place the elevator car in motion and/or make an announcement;
- if one or more objects is or are located too close to the door region, either wait until the situation has changed or make an announcement; and
- if an object has moved in the direction of the doors, appropriately adapt the door opening or closing process (for example, stop or slow down closing of the doors).

If neither a person nor an object was detected, the flow chart branches at "No" by way of the branch 60 back to the beginning and the entire process is repeated again. According to this chart, any branched decision trees can be realized in order to ultimately be able to automatically trigger a reaction which corresponds with the prevailing situation or is adapted thereto.

The described method steps are preferably performed in a processing device, wherein an appropriate software module is used. Preferably three-dimensional mathematical operations are used in the evaluation of the distance information.

The processing device can additionally be so extended with respect to the area monitoring that the following door states are recognizable:

- door gap,
- position of the elevator door,
- closing behavior of the elevator door,
- object in the region of the elevator door.

Depending on the recognized door state a situation-adapted reaction is then triggered by the processing device. This can be one or more of the following reactions:

- stop door closing process,
- stop door opening process,
- slow down door closing process,
- slow down door opening process,
- trigger loudspeaker arrangement,
- place service call,
- trigger emergency call,
- stop elevator operation,
- continue elevator operation at reduced speed,
- initiate evacuation of the elevator car,
- etc.

Depending on the respective embodiment, a device according to the present invention can recognize one or more of the following states:

- number of passengers in the elevator car or in the access region (lobby) in front of the elevator shaft,
- number of persons entering or leaving the elevator,
- directional flows of persons,
- overload,
- incorrect loading,
- obstructions in the door region,
- need detection,
- movements,
- door gap,
- position of the elevator door,
- closing behavior of the elevator door,
- object in the region of the elevator door.

Depending on the respective embodiment, a device according to the present invention can trigger one or more of the following reactions:

- no closing of the elevator doors as long as persons are located in the access region of the story in which the elevator car is just located,
- situation-dependent controlling of the elevator car in order to be able to take into account arrival of persons at individual floors,
- elevator car stops only at a floor when persons wait in the access area of the corresponding floor,
- automatic calling of a elevator car if a person approaches a shaft door and stays there,
- traffic-dependent or need-dependent controlling, for example in the case of elevator installations with several elevator cars,
- initiation of emergency measures if a problem is recognized or a risk to a person is possible,
- display information and/or trigger an announcement,
- allow or prohibit access to a floor,
- allow or prohibit use of the elevator car, statistical evaluations of, for example, the number of persons, frequency of use, etc., pay-elevator functions.

Figure 5A:
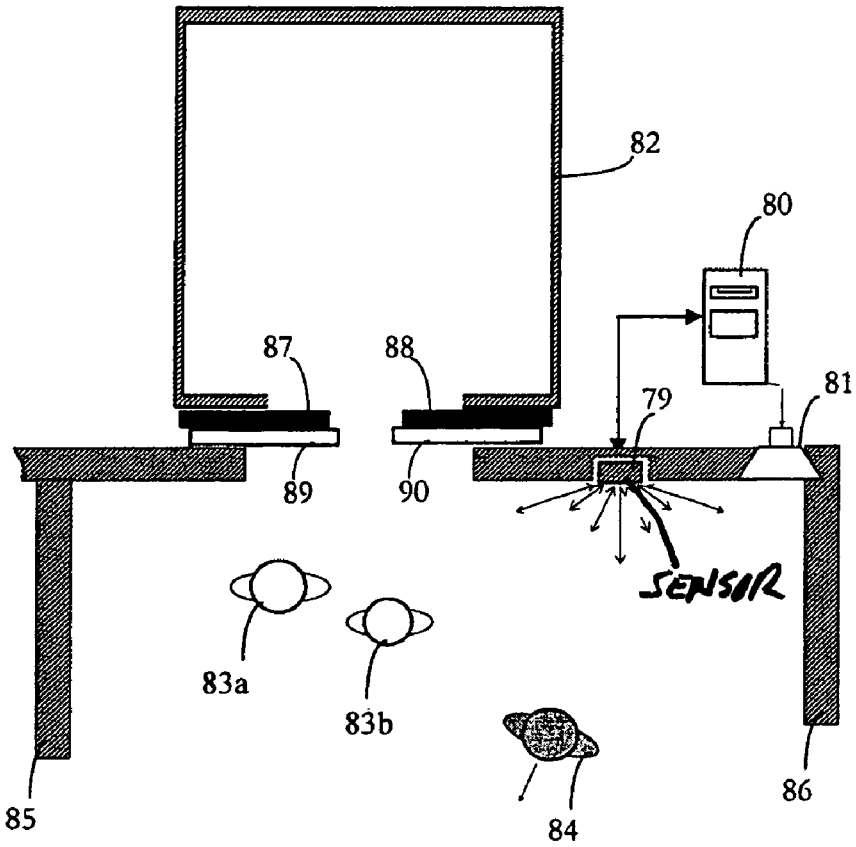
FIG. 5A is a schematic plan sectional view of an elevator car, inclusive of an access area, with a sensor and a device according to another embodiment of the present invention.
Figure 5B:
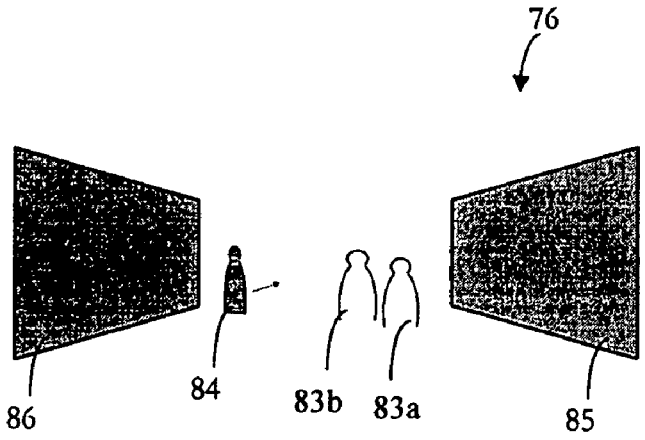
FIG. 5B is a schematic side elevation sectional view of the elevator car of FIG. 5A.

A further embodiment of the invention is shown in FIGS. 5A and 5B. This is a device for monitoring the access region in front of an elevator shaft. In the schematic plan view in FIG. 5A there is shown an elevator car 82 located at a floor of a building. The car 82 is separable by car doors 87, 88 and shaft doors 89, 90 from the access region. The doors 87 to 90 are slightly opened in the illustrated depiction. A sensor 79 according to the present invention, which is connected with a processing device 80, is located in a wall near the elevator. A loudspeaker 81 is provided by way of which announcements can be made. The access region is laterally bounded by walls 85 and 86. A situation is illustrated in which in total three persons 83*a*, 83*b*, 84 are in the access region. The persons 83*a* and 83*b* stand directly in front of the doors 87 to 90 and wait until these doors have opened. A further person 84 moves away from the doors 87 to 90, as indicated by an arrow. The device according to the present invention is in a position of detecting this state. The device generates a three-dimensional distance image 76 which is schematically shown in FIG. 5*b*. The device recognizes that three persons are in the access region. Moreover, it is in a position of monitoring whether the persons 83*a* and 83*b* too closely approach the opening doors 87 to 90. If this should be the case, then the opening movement of the doors could be stopped so as to avoid risk to persons. As soon as the doors are completely open, the persons 83*a*, 83*b* enter the elevator car 82. This process can also be monitored. The doors 87 to 90 can close automatically as soon as the two persons 83*a*, 83*b* have entered the elevator car 82 to sufficient extent. The person 84 is further detected by the device. Since, however, this person 84 moves away from the doors the elevator car does not wait for this person 84.

The described embodiments can be extended in that the processing device 20, 50, 80 is so designed in terms of software that not only can it be recognized whether and where persons and/or objects are located, but also the objects or persons can be classified or categorized by comparison operations.

The illustrated embodiments can be extended in that a sequence of several images successive in time is supplied to the processing device 20, 50, 80. In this case the processing device 20, 50, 80 can, by suitable processing of the image information, ascertain, additionally to pure detection of persons and/or objects, also the movement direction and/or speed of the persons and/or objects. This movement information can be used in order to trigger situation-adapted reactions by generating corresponding output signals from the processing device 20, 50, 80. If, for example, the processing device 20, 50, 80 determines that a person moves slowly while the doors of an elevator close, then the closing of the doors can be interrupted or the closing movement stopped. If the person is one who moves quickly, it can be sufficient, for example, to slow down the closing movement of the doors or to interrupt the closing movement only for a short moment. It is conceivable as a further reaction to trigger an announcement in order to ensure that nobody stays in the door region.

As shown in FIGS. 1A, 1B and 3, the device according to the present invention can be used for simultaneous monitoring of the car interior space, car doors and shaft doors.

If it is primarily desired to monitor the interior space of an elevator car then the sensor can be mounted in the region of the car ceiling, as can be schematically recognized in FIGS. 1A, 1B and 3.

If the sensor is arranged in the region of the rear wall of a car, i.e. in the region of the wall opposite the car doors, then when the doors are opened it is possible to detect not only the state of the interior space of the car, but, via the opened doors, also a region in the lobby in front of the car.

In the case of the configurations shown in FIGS. 1A, 1B and 3 the sensor moves together with the elevator car from floor to floor. The shaft doors of the individual floors and the access region of the floors cannot, in the absence of the car, be monitored by the sensor at the car. It is recommended to use a sensor according to the present invention on each floor, as shown in, for example, FIG. 5A.

There are obviously numerous other possibilities of arranging the sensor or sensors In general, it is to be observed in the mounting of the sensor that the sensor should be as free as possible from being able to be influenced by external influences (objects and/or persons, weather, mechanical damage, etc.).

Figure 6:
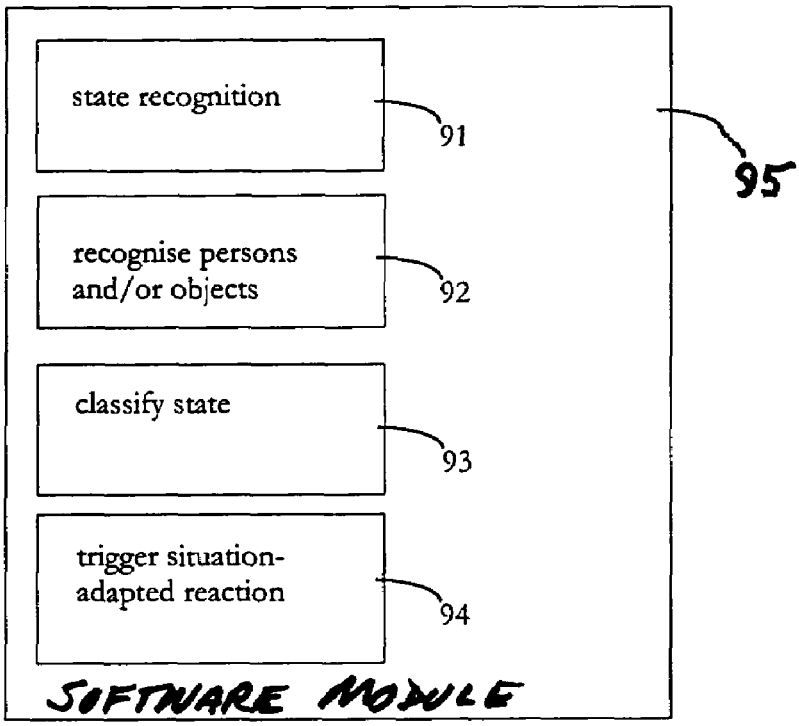
FIG. 6 is a schematic block diagram of a software module according to the present invention.

A software module 95 according to the present invention for use in a processing device of an elevator is shown in FIG. 6. The software module 95 performs the following steps when it is called up and executed by the processing device:

evaluation of distance information (submodule 91), which is provided by a three-dimensional sensor in the area, which is to be monitored, so as to detect the state of the area, recognition whether persons and/or objects are located in the area to be monitored (submodule 92), classification (submodule 93) of the state, and triggering (submodule 94) of a situation-adapted reaction.

The software module 95 can comprise further modules.

Preferably the light source and the sensor group are arranged in a housing. The mounting is thereby facilitated, since the light source does not have to be manually oriented with respect to the sensor group. The orientation of the two components can be carried out already at the time of manufacture or pre-assembly.

In a further embodiment the processing device compares the image information with one or more reference images in order to obtain information about the area state. For this purpose, for example, a reference image can be subtracted from the image information.

According to an improved embodiment the area monitoring is carried out continuously by a succession of numerous light pulses and processing thereof. Reliability in the elevator field can thus be increased by comparison with conventional, mechanical approaches.

The area monitoring according to the present invention is suitable not only for use within buildings, but also for use outside, since the sensor employed has little susceptibility to disturbance. Above all, however, the insensitivity to extraneous light is a more significant aspect when dealing with use within or outside buildings.

The area monitoring according to the present invention is not only able to recognize events, but also able to undertake a classification. Thus, for example, it is possible for the area monitoring to recognize whether anybody waits in the access region to an elevator car. It is also ascertainable how many persons wait, or whether a person to be conveyed or an object to be transported actually has space in the elevator car. Even the number of persons or objects and, for example, the size thereof can be ascertained.

A further embodiment is distinguished by the fact that it can be recognized by means of area monitoring whether an elevator car is needed at a specific floor. This can be realized in that the area monitoring observes the access area at the corresponding floor. If a person approaches the shaft doors and waits there, then the device concludes therefrom that the person is waiting for an elevator car. This form of embodiment can even be extended in that the access region is divided into two zones. If a person stays in the zone provided for journeys in an upward direction, then an elevator car on the way up stops. If a person is detected in the zone allocated to journeys in a downward direction, then the next car on a journey down stops. A need recognition and a need-dependent elevator control can thus be realized. It is an advantage of this embodiment that the elevator installation can be operated completely without the usual request buttons. The entire system operates in completely contactless manner.

If a conventional communications connection for connecting the sensor with the processing device is used then due to the safety relevance of the data (image information) to be transferred from the sensor to the processing unit suitable measures should be undertaken to guarantee security during transfer of the data by way of the intrinsically insecure communications connection.

The device according to the present invention can be connected by way of a communications connection and/or by way of a network with a processing device (for example, with a computer) which further processes the image information supplied by the sensor, prepares it and optionally stores it. Thus, a monitoring system can be realized which, for example, centrally monitors an elevator installation with several elevator shafts.

Preferably a device according to the present invention is integrated into the safety circuit of an elevator. The safety circuit thereby has more performance capability and the elevator is more reliable. As a consequence, in certain circumstances the serviceability of the elevator can thereby be improved. Operational disturbances can be reduced in the case of suitable design of the device according to the invention.

An advantageous development of the present invention makes it possible to so expand the area monitoring that protection against being caught can be realized. The protection, in accordance with the present invention, against being caught makes it possible to detect a person in good time and trigger a suitable reaction in order to, for example, reduce the risk of being caught in the door region.

A further advantage of a solution according to the present invention by means of a three-dimensional sensor is to be seen in that sensors of that kind have a relatively short cycle time (less than 20 milliseconds). Thus, very rapid monitoring solutions can be realized. Critical states can be detected more quickly and reactions triggered in good time. The present invention makes it possible to realize monitoring systems which have a reaction time, for recognition of objects, of a few milliseconds. The rapid recognition makes it possible to very trigger a suitable reaction very quickly.

The three-dimensional sensors employed enable evaluation of the third dimension, which is advantageous by comparison with one-dimensional systems (for example, light barriers) or two-dimensional systems (for example, light gratings or charge-coupled-device cameras). Through detection of three dimensions the area monitoring can obtain, in direct mode and manner, an image, which is close to reality, of the actual state.

It is an advantage of the semiconductor sensor employed that this operates with an intrinsic light component. Thus, the system is substantially independent of the environmental conditions and functions even in darkness. As a further advantage it can be asserted that the invention can be realized without a calibrating mechanism usually employed in the case of camera-based systems to take account of changed environmental conditions. In the case of a camera-based system, for example, the light sensitivity is adjusted by a calibrating mechanism. This outlay is eliminated.

A further embodiment of the present invention is distinguished by the fact that the processing device is so designed that the image information can be stored. Thus, it is possible to document a critical process, for example catching of a person when entering or leaving the elevator car, by means of image information. Image information of that kind can serve for, for example, securing evidence.

In a further embodiment of the present invention a service call is triggered, as a reaction, as soon as a problem is recognized. In addition, an emergency call can possibly be made in the case of a critical state.

Advantageously, the evaluation of the image information supplied by the three-dimensional sensor can be linked with the elevator control in order to enable synchronization of the information processing. Thus, a regulating circuit can be installed which, depending on the respective state, triggers an appropriately adapted reaction.

It is an advantage of the present invention that the waiting times can be reduced, since the elevator can be controlled in such a manner that it is in a position of automatically adapting to changing conditions. It is thus possible, for example, to avoid stopping of the car at a floor although nobody waits there or waits there any longer.

In a further advantageous embodiment the area monitoring according to the present invention is combined with an access control system. Thus, for example, it can be automatically checked whether only authorized persons use an elevator. This is possible, for example, if all access-authorized persons are equipped with a badge. A person desiring access to the elevator must identify himself or herself by means of a badge relative to a badge reading apparatus. The access control counts the number of persons who have shown by badge that access to the next elevator car is desired. On entry into the elevator car the system according to the present invention can ascertain how many persons have actually entered the elevator. If the number of persons in the car does not correspond with the number of persons who have identified themselves by a badge, then a reaction can be triggered. It is possible, for example, not to place the elevator in motion and to make an announcement in order to require the persons to again identify themselves by badge.

A pay-per-use (pay-elevator) approach can be realized in similar mode and manner. All persons who want to use the elevator must pay a certain fee. The number of persons who have paid can be counted. After all persons have entered the car an automatic determination of the number of persons is carried out. In the case of deviations, appropriate measures can be undertaken. Thus, for example, a ticket check can be triggered.

A further pay-per-use system is based on the use of a key or a badge by which a person to be transported registers himself or herself. This registration is detected and the fee to be paid is charged to the appropriate person. If more persons are located in the elevator car than were detected, then an appropriate reaction can be triggered.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for area monitoring at least one of within and outside an elevator car comprising:

a three-dimensional semiconductor sensor for detection of image information, the three-dimensional semiconductor sensor including, a light source mounted in an elevator car area to be monitored and at least partly illuminating the area to be monitored, a sensor group mounted to receive light reflected in the area to be monitored and convert said received light into electrical signals, and a processing chip connected to said sensor group for converting said electrical signals into the image information; and a processing device connected to said sensor for generating three-dimensional image information from said image information and processing said three-dimensional image information to generate state information representing a state of the area to be monitored.

2. The device according to claim 1 wherein said three-dimensional image information includes individual images and said processing device compares said individual images including at least one image stored in a memory connected to said processing device.

3. The device according to claim 1 wherein said three-dimensional image information includes individual images, said processing device compares said individual images, and said individual images are received from said sensor group successively in time.

4. The device according to claim 1 wherein said light source generates light successive pulses to at least partly illuminate the area to be monitored.

5. The device according to claim 1 wherein said processing device generates different output signals to trigger specific reactions based upon said state information.

6. The device according to claim 1 wherein said sensor is mounted in a ceiling region of the elevator car.

7. The device according to claim 1 wherein said processing device performs three-dimensional mathematical operations on said image information to generate said three-dimensional image information.

8. The device according to claim 7 wherein said mathematical operations are based on an integration method.

9. The device according to claim 1 wherein said light source radiates light in an infrared range.

10. The device according to claim 1 wherein said light source is at least one of a light-emitting diode and a laser diode.

11. The device according to claim 1 wherein said sensor group is an image sensor and said processing chip is a CMOS processing chip.

12. The device according to claim 1 wherein for reducing extraneous light influences said processing device generates said three-dimensional image information by double scanning the area to be monitored including one scan with said light source on and a second scan with said light source off.

13. A method of monitoring an elevator area, wherein light reflected in the area to be monitored is detected by a sensor, comprising the steps of:

a. ascertaining three-dimensional image information from the reflected light with consideration of the transit time and/or phase position of the light;

b. evaluating the three-dimensional image information for recognition of a state of the area to be monitored;

c. classifying the state; and d. triggering a situation-adapted reaction based upon the classification of the state.

14. The method according to claim 13 including performing said step b. by recognizing whether a person or an object is located in the area to be monitored.

15. The method according to claim 13 wherein said step b. is based upon three-dimensional mathematical operations.

16. The method according to claim 13 wherein said step b. includes recognizing at least one of the states of:

a number of passengers in an elevator car or in an access area in front of an elevator shaft;

a number of persons entering or leaving the elevator car;

a directional flow of persons;

an overload of the elevator car;

an incorrect loading of the elevator car;

an obstruction in a door region of the elevator shaft;

a need detection;

a movement;

a door gap of the elevator door;

a position of the elevator door;

a closing behavior of the elevator door; and an object in the region of the elevator door.

17. A device for area monitoring at least one of within and outside an elevator car comprising:

a three-dimensional semiconductor sensor for detection of image information, the three-dimensional semiconductor sensor including, a light source mounted in an elevator car area to be monitored and at least partly illuminating the area to be monitored, a sensor group mounted to receive light reflected in the area to be monitored and convert said received light into electrical signals, and a processing chip connected to said sensor group for converting said electrical signals into the image information; and a processing device connected to said sensor for generating three-dimensional image information from said image information and processing said three-dimensional image information to generate state information representing a state of the area to be monitored, wherein for reducing extraneous light influences said processing device generates said three-dimensional image information by double scanning the area to be monitored including one scan with said light source on and a second scan with said light source off.

* * * * *